United States Patent [19]

Caves et al.

[11] 4,170,313

[45] Oct. 9, 1979

[54] BOX AND BLANK FOR FORMING THE BOX

[76] Inventors: Robert B. Caves, 17018 Edwards Rd., Cerritos, Calif. 90701; Walton B. Crane, 4346 Matilija, Sherman Oaks, Calif. 91403

[21] Appl. No.: 865,377

[22] Filed: Dec. 29, 1977

[51] Int. Cl.[2] ..... B65D 7/24; B65D 7/42; B65D 9/14

[52] U.S. Cl. ..... 220/7; 229/30; 220/6

[58] Field of Search ..... 220/6, 7, 339; 229/30

[56] References Cited

U.S. PATENT DOCUMENTS

| | | | |
|---|---|---|---|
| 3,330,437 | 7/1967 | Bellamy | 220/6 X |
| 3,497,127 | 2/1970 | Box | 220/6 X |
| 3,655,114 | 4/1972 | Turner | 229/30 |
| 3,675,808 | 7/1972 | Brink | 220/7 |
| 3,858,745 | 1/1975 | Cloyd | 229/45 X |
| 3,874,546 | 4/1975 | Sanders et al. | 229/30 X |
| 3,973,692 | 8/1976 | Cloyd | 220/7 |
| 4,005,795 | 2/1977 | Mikkelson | 220/7 |
| 4,044,910 | 8/1977 | Box | 220/6 |

*Primary Examiner*—Davis T. Moorhead
*Attorney, Agent, or Firm*—Donald D. Mon

[57] ABSTRACT

A box folded from a box blank. The box blank has a nominally planar bottom member and four nominally planar sidewall members. The sidewall members are disposed in a cruciform array. Each of said members has an edge. Respective edges of the bottom member and sidewall members are adjacent to each other in pairs, and are laterally spaced apart from one another along a respective fold axis. A strap hinge is respective to each pair of edges, joining the members together whereby to permit rotation of the members relative to one another along the fold axis. A tooth is formed on one of the members and a recess is formed in the other of the members, the tooth and recess each having a restraint face which when engaged by the other restrains the member from lateral translational separation normal to the fold axis along the plane of one of the members. The box blank is preferably made of molded plastic and can be formed in a single piece.

15 Claims, 12 Drawing Figures

BOX AND BLANK FOR FORMING THE BOX

This invention relates to a box foldable from a box blank and to the said box blank.

Especially for agricultural field boxes, it is advantageous to ship the boxes flat to a location as close as possible to the point of use, and set the boxes up there. However, known box configurations generally require equipment to complete the set-up, which limits the assembly process to locations where the equipment is. Depending on the complexity of the equipment, this can be fairly far from the point of use. Furthermore, the equipment is subject to breakdown and misuse.

It is also advantageous to provide a box blank which is unitary, i.e., including all parts in one piece which parts are necessary to form the bottom half of the box. This prevents loss or inventory imbalance in the field.

It is an object of this invention to provide a box with the above advantages. It can even be molded as a single piece from insulating material.

A box according to this invention is folded up from a box blank. The box blank has a nominally planar bottom member and four nominally planar sidewall members. The sidewall members are disposed in cruciform array around the bottom member. Each of said members has an edge. The edges are adjacent to each other in pairs, and are laterally spaced apart from one another along a respective fold axis. A strap hinge is respective to each of said edges, and joins the respective members together. The hinges are flexible, whereby to permit rotation of the members relative to one another around the fold axis. A tooth is formed on one of said members, and a recess if formed in the other of said members. The tooth and recess each has a restraint face which, when engaged by the other, restrains the members from lateral translational separation normal to the fold axis along the plane of one of the members. The tooth and recess are so disposed and arranged as to be interengaged when the blank is folded, with the plane of the sidewall member normal to the plane of the bottom member. Preferably, but not necessarily, the teeth and recesses are alternated along each fold axis, or at least from axis to axis.

According to a preferred but optional feature of the invention, each of the said members has an abutment surface at each of said pairs of edges, said abutment surfaces being substantially normal to one another when the nominal planes of the members are disposed parallel to one another, and are in abutment with one another when the members are normal to one another.

According to another preferred but optional feature of the invention, each recess and each tooth is partially bounded by respective pair of axially spaced apart end walls. These end walls abut one another in pairs when the nominal planes of the members are normal to one another, whereby to resist shear-wise movement of the members relative to one another along said fold axis.

The above and other features of this invention will be fully understood from the following detailed description and the accompanying drawings, in which.

Figure 1:
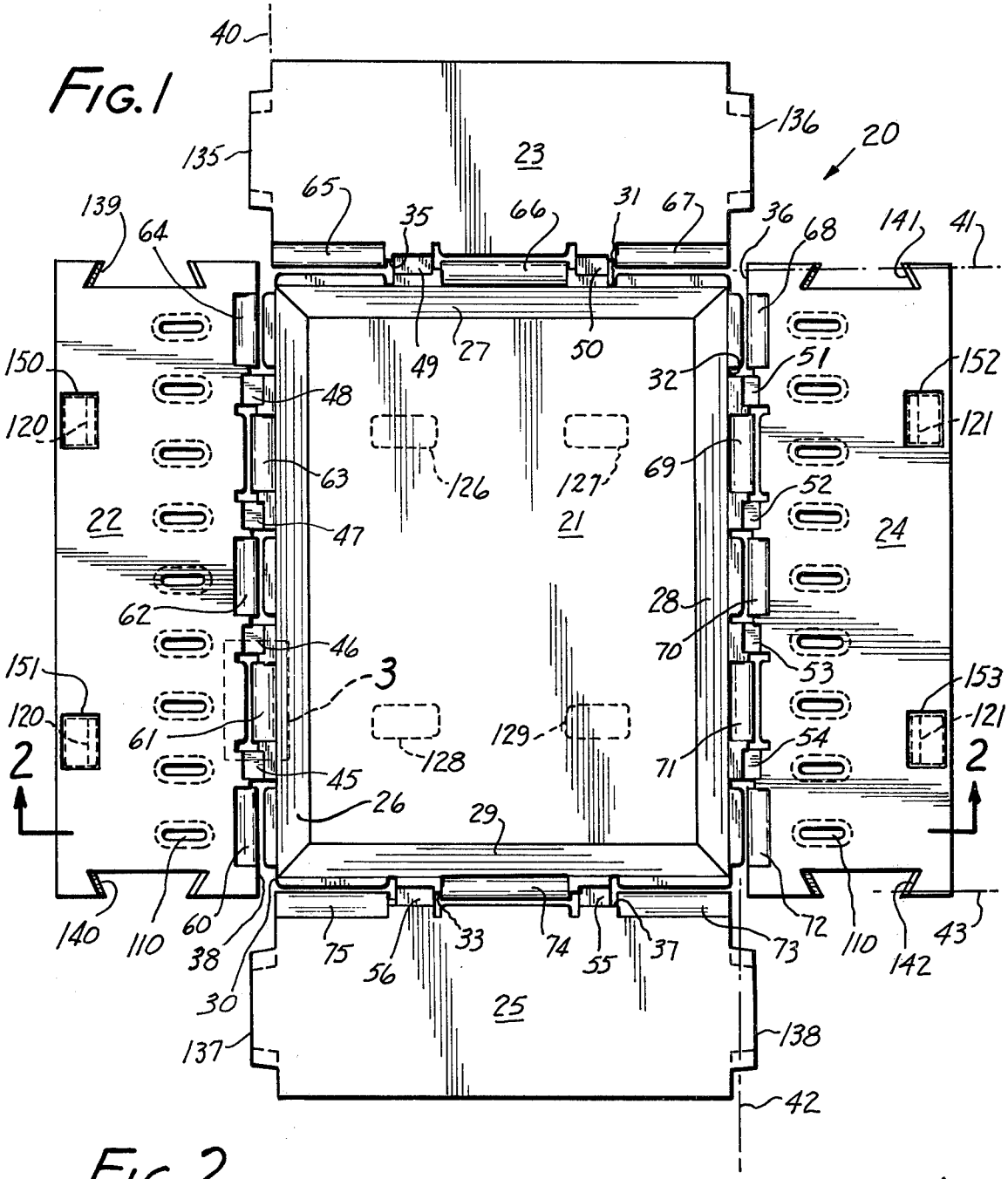
FIG. 1 is a top plan view of a flat box blank according to this invention.
Figure 6:
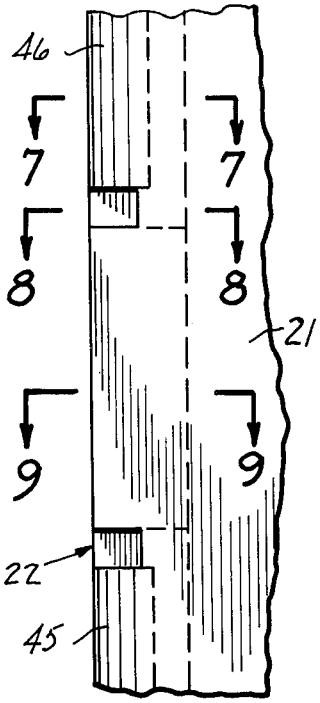
Figure 10:
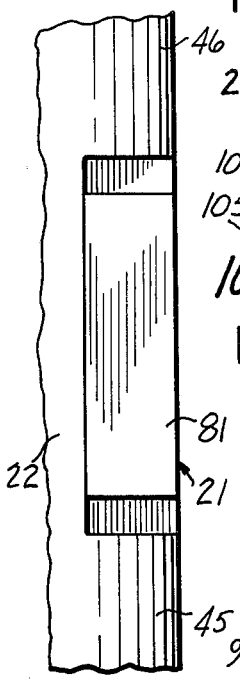
Figure 7:
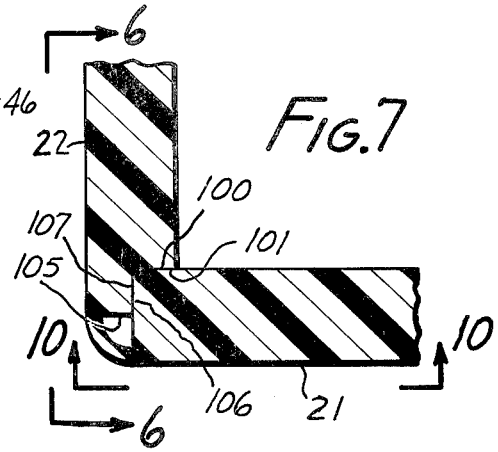
Figure 8:
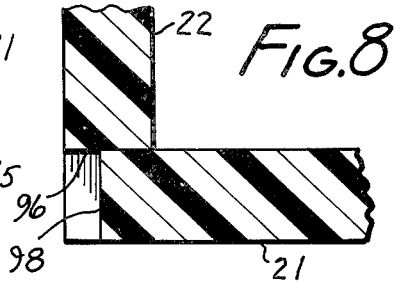
Figure 3:
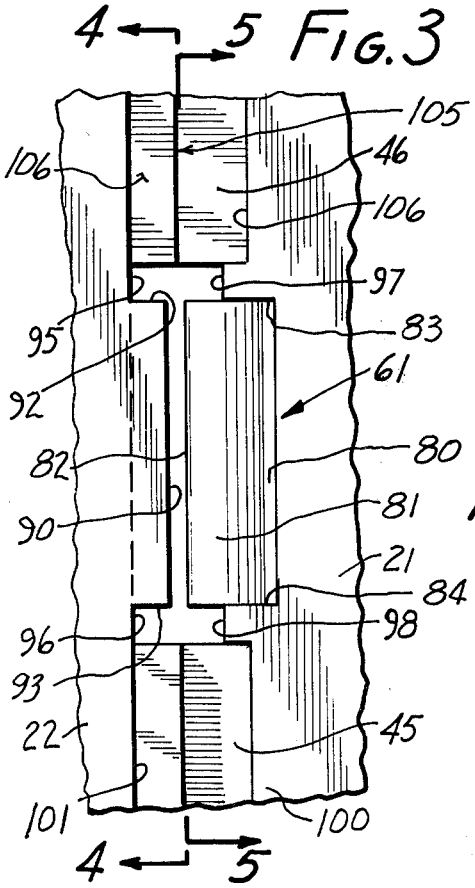
FIG. 3 is an exemplary fragmentary portion of FIG. 1 taken at region 3 therein.
Figure 9:
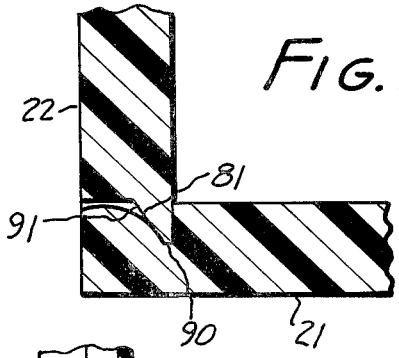
Figure 4:
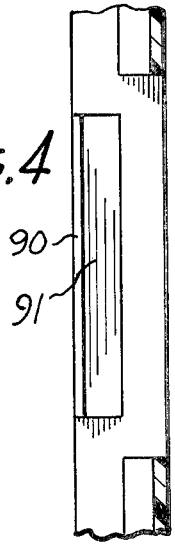
Figure 5:
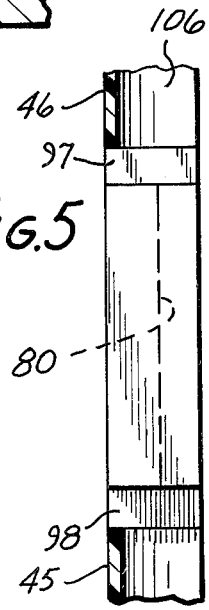
Figure 11:
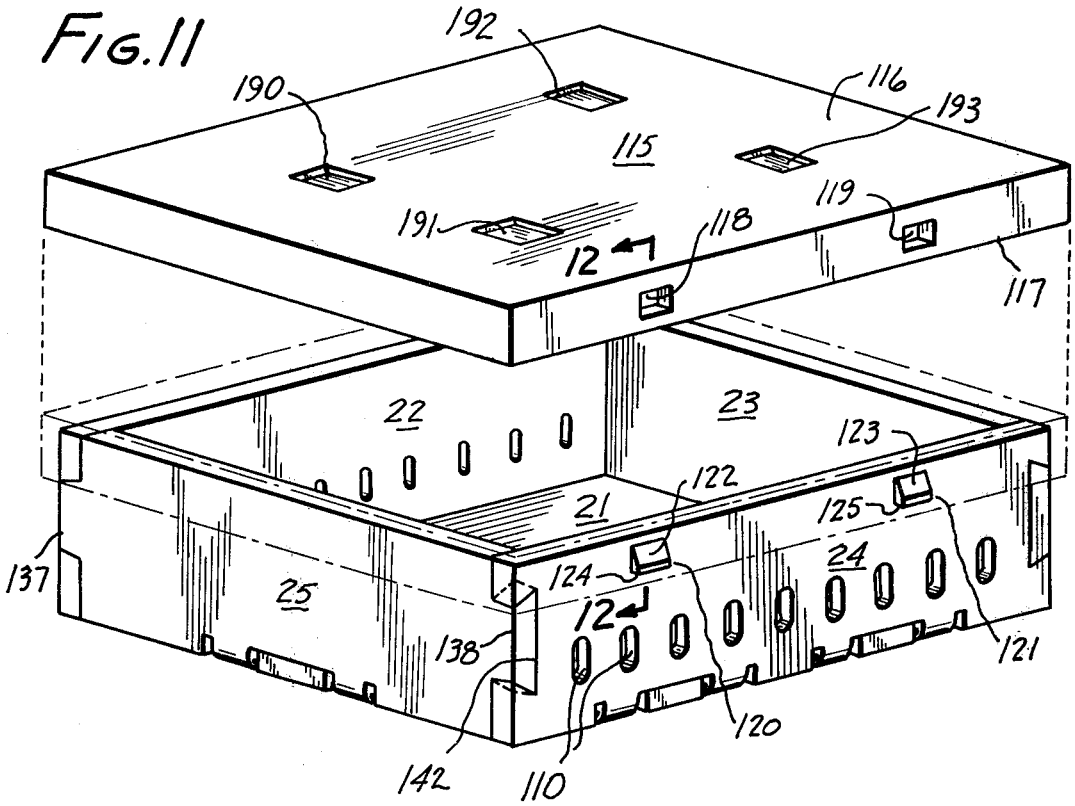
Figure 12:
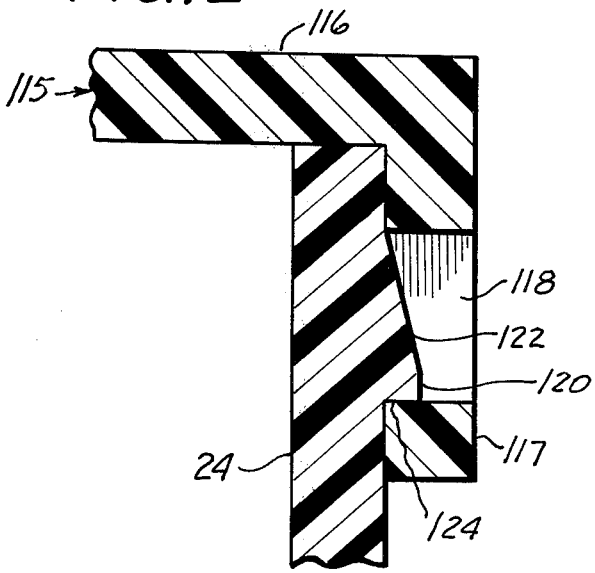

FIGS. 4 and 5 are cross-sections taken at line 4—4 and 5—5 respectively in FIG. 3;

FIG. 6 is a fragmentary side elevation taken at line 6—6 in FIG. 7;

FIGS. 7, 8 and 9 are cross-sections respectively taken at lines 7—7, 8—8, and 9—9 in FIG. 6;

FIG. 10 is a fragmentary side elevation taken at line 10—10 in FIG. 7;

FIG. 11 is a perspective view showing a box assembled from the blank of FIG. 1 with a lid about to be attached; and FIG. 12 is a fragmentary cross-section showing an interengagement of the lid and the box.

FIG. 1 shows a blank 20 according to the presently preferred embodiment of the invention. It includes a nominally planar bottom member 21, and four nominally planar sidewall members 22, 23, 24, 25. The sidewall members are arranged in generally cruciform fashion around the bottom members.

Figure 2:
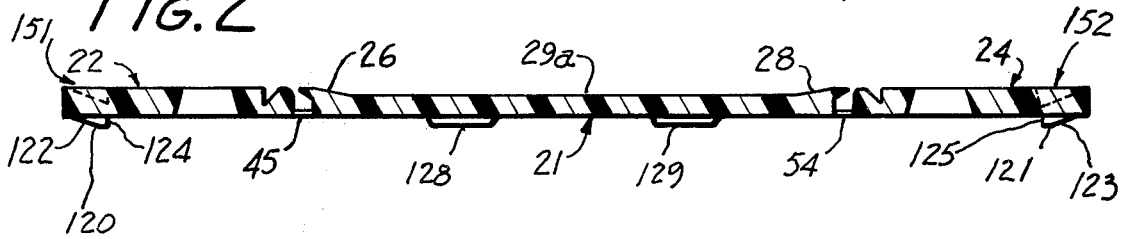
FIG. 2 is a cross-section taken at line 2—2 of FIG. 1.

The bottom member is somewhat sloped near its edges as can best be seen in FIGS. 1 and 2. Four sloped portions 26, 27, 28, 29 are provided. These are not especially deep, but the depression **29*a* (FIG. 2**) they provide is useful in the grouping of items in the box, and provides a space to receive the foot on the bottom of the flat box blank which is stacked on it, thereby enabling the box blanks to be stacked in a stack of minimum height defined by the thickness of the members. This also reduces the amount of material necessary to form the bottom member.

The term "nominally planar" as used herein means a member which extends in two lateral directions although not necessarily as a flat plane. For example, it could include depressions (as the illustrated embodiment does) or a plurality of depressions or receptacles, or any other desired surface construction. However, because this is intended to be a folded blank intended for maximum number of boxes storable in a minimum cubic volume, the members will not ordinarily differ very much, if at all, from a flat planar construction. A construction differing no farther from true flat than that shown in FIG. 2 is the preferred embodiment and is the best known mode of accomplishing the invention.

The bottom member has four edges 30, 31, 32, 33. Sidewall members 22, 23, 24, 25 have edges 35, 36, 37 and 38. Therefore edges are provided in pairs 30, 38; 31, 35; 32, 36; and 33, 37. These edges of the adjacent members are spaced apart from one another and extend generally parallel to respective fold axes 40, 41, 42, 43 around which the members rotate when the box blank is set up. The sidewall members are hinge mounted to the bottom member by strap hinges. For example, members 21 and 22 are joined by strap hinges 45, 46, 47 and 48. Members 21 and 23 are joined by strap hinges 49, 50. Members 21 and 24 are joined by hinges 51, 52, 53 and 54. Members 21 and 25 are joined by hinges 55 and 56. These hinges, as will later be seen, are integral with the members although they could instead be attached to them by means such as cementing, stapling, or otherwise. They are flat and flexible. They enable the sidewall member to be hinged relative to the bottom member for the purpose of set up.

In order to provide for a stabilizing and interlocking relationship, a plurality of stabilizer members is provided. Stabilizer members 60, 61, 62, 63 and 64 are provided between members 21 and 22. Stabilizer members 65, 66 and 67 are provided between members 21 and 23. Stabilizer members 68, 69, 70, 71 and 72 are provided between members 21 and 24. Stabilizer members 73, 74 and 75 are provided between members 21 and 25. These stabilizer members are all identical and for best results they are reversed in orientation alternately along each of the fold axes, or at least from axis to axis, as will later be described. Because they are identical, only stabilizer member 61 shown at region 3 in FIG. 1 will be described in detail being understood that the others are identical in construction and operation.

FIG. 3 shows region 3 in FIG. 1 and especially illustrates stabilizer member 61. Bottom member 21 has a recess 80 disposed in its upper surface. This recess is partially bounded by a restraint face 81 which includes a lead-in portion 82. The lead-in portion is generally curved for a purpose yet to be described. A pair of end walls 83, 84 bound the ends of the recess. A complementary tooth 90 is formed on the edge of sidewall member 22 and projects toward the bottom member when the blank is laid flat. The tooth has a restraint face 91 intended to abut against restraint face 81 of the bottom member when the sidewall member is folded up. This exerts a restraint against lateral translational separation normal to the fold axis along the plane of the bottom member as is yet to be described. The tooth terminates in end walls 92, 93 which can abut end walls 83 and 84 respectively for the purpose of resisting relative shear movement of the two members along the fold axis 40.

A groove 95 and a groove 96 are formed at each edge of the tooth, and a spline 97 and a spline 98 are formed at each edge of the recess. These also can inter-engage one another to provide restraint against shear-wise movement along the fold axis.

As can be seen from an examination of the drawings, the tooth constructions are applied alternately to the sidewall member and to the bottom member and so are the recess constructions. Accordingly, the actions of the stabilizing members in stabilizing the devices are complementary to one another in alternate pairs and exert their restraint on alternating planes. Therefore a pair of alternated stabilizer members stabilizes the fold along both planes of the dihedral angle.

This arrangement does still more. If all of the teeth were in the sidewall members, they would all point downwardly, and give sidewise restraint. The sidewall members could not move laterally away from the bottom member. This would make a good box if the box were picked up by the bottom. However, except for restraint by the hinge means, the sidewall members could be pulled up and off of the bottom member. This is because each tooth provides restraint in only one plane (or more specifically, along only one axis).

However, if the teeth and recesses are alternated, their restraint is provided in two planes (or on two axes), and the sidewall members are held both laterally and vertically, so the bottom member can be lifted by the sidewall members without separation. Also the sidewall members cannot move laterally. Evidently, the best construction is as shown, with a plurality of stabilizer means on each edge, and with at least one tooth and one recess in each edge. It is equally evident that, if the sidewall members are suitably interconnected so that they become in effect a continuous band, then alternation of teeth and recesses along each edge, while best, is not as important as having some facing in each direction, for example, by alternating the orientation of the teeth and recesses not necessarily along each edge, but from edge to edge (fold axis to fold axis), for example, a tooth or teeth on one edge of the bottom member, and a recess or recesses on the next edge of the bottom member, and so on. Then the assembled sidewall members, connected at the corners such as by key means yet to be described, or encircled by a band or wrapping, would be restrained in two planes, i.e., the sidewall members cannot move laterally or upwardly relative to the bottom member.

An abutment surface 100 is provided around the edge of the bottom member. Abutment surfaces 101 are provided on the edges of each of the sidewall members. Surfaces 100 and 101 are exemplary of all pairs of the surfaces. They are normal to one another when the box blank is laid flat and abut each other when the box is folded (see FIG. 7). In the preferred form of this invention, there is a second pair of abutment surfaces formed by step 105 on the sidewall member. This step has an abutment surface 106 which is parallel to abutment surface 100, and the bottom member has an abutment surface 107 on its edge which is normal to abutment surface 101, this causes a dual engagement of abutment surfaces as best shown in FIG. 7.

Ventilation holes 110 (FIG. 11) are formed through sidewall members 22 and 24. A lid 115 has a top 116 and a skirt 117. The skirt is provided on two of its sides with retention holes 118, 119 which are intended to hook over retainers 120, 121 on sidewall members 22 and 24. The skirt is somewhat springily flexible and can snap over these retainers. The retainers are provided with respective ramps 122, 123 and with retention surfaces 124, 125 respectively. Feet 126, 127, 128, 129 are formed on the bottom of the bottom member to hold it off the ground. The depth of depression **29*a*** is about equal to the height of these feet. The feet thus fit nicely into the depression when the blanks are stacked flat. The height of the flat stack of blanks is thus kept to a minimum.

Key means 135, 136 are provided on sidewall member 23 and key means 137, 138 are provided on sidewall member 25. These are intended to engage in key recesses 139, 140 on sidewall member 22 and recesses 141, 142 on sidewall member 24. Means 135–138 are male, and recesses 139–142 are female. They are also tapered on their edges so as to provide for ready entry, and also for locking.

Sinks 150, 151 and 152, 153 (FIG. 1) are provided in sidewall members 22 and 24 where they will receive retainers 120 and 121 when the blanks are stacked flat. This enables the sidewall members to stack flat against one another in a stack of minimum height.

Sinks 190–193 are formed in the top of lid 115 to receive feet 126–129 when the bottom of one box is stacked onto the lid of a box beneath it. This gives "side" support to the stack.

While this box can be constructed of many different materials, and different parts of it can be constructed of different materials, a principal advantage of the illustrated construction is that it can be cast as a unitary product in a single casting operation. Expanded polystyrene which is steam cured is a preferred item of construction. It can readily be compressed at the hinges to provide a tough resilient hinge suitable for a substantial number of flexures without cracking. A box made of this material is optimally light and can be insulating.

The members may conveniently be on the order of $\frac{3}{8}$–$\frac{1}{2}$ inch thick. The strap hinges are on the order of $\frac{1}{8}$ inch thick and usually about 1 inch in axial length. In this design, all shapes can be formed by molding from the top and the bottom with the plane of the laid-flat blank being the separation plane of the two parts of the mold. When the box is to be set up, the sidewall members are merely turned up relative to the bottom member at which time the tongues enter the recesses and the restraint surfaces bear against each other. Each stabilizer member provides for restraint in one plane of one of the members. When they alternate i.e., when there are two of them along a given fold axis, then the restraint is formed against each of them so as to provide a firm interlocking relationship on the two planes of the dihedral. The strap hinge serves to guide the tooth into the recess, and the lead-in surfaces curve so as just about to clear the tooth as it swivels into the recess. The abutment surfaces bear against each other, and the splines enter the grooves. When the teeth and recesses alternate along a fold axis, the lead-in surfaces neatly guide the stabilizer means into proper alignment.

The members are interlocked at the corners if the key means are provided. They are optional, because the stabilizer means will adequately hold the device together. Instead of the key means, it is also possible to wrap a length of tape around the set-up box. However, the device shown is optimal in construction and effect.

Once the stabilizer means are assembled together, then the hinges are no longer necessary. They serve to hold the blank together before it is set-up to form the box and guide the parts relative one another. After the stabilizer means have been joined, an especially when the teeth have engaged in their recesses, there is no further function for the hinge except perhaps as a secondary protection, or of course as a means to hold the blank together when the box is demounted and stored again, if such is to be the situation.

This invention thereby provides an elegantly simple blank to form a useful box. It can be carried in large quantity and small volume as a flat blank, and quickly assembled by unskilled personnel in the field to form an optimal container.

This invention is not to be limited by the embodiments shown in the drawings and described in the description which are given by way of example and not of limitation, but only in accordance with the scope of the appended claims.

I claim:

1. A box blank foldable to form a box having a bottom and four sidewalls, said blank comprising:

a nominally planar bottom member having four edges in rectangular array, said bottom member having a top surface;

four nominally planar sidewall members, each said sidewall member having an edge, each sidewall member being adjacent to a respective one of said edges of the bottom member, the pairs of sidewall member edges and bottom member edges being adjacent to each other, the members of said pairs being laterally spaced apart from one another along a respective fold axis;

a strap hinge respective to each said pair of edges joining the said members together, said hinges being flexible, whereby to permit rotation of said members relative to one another around said fold axis; and a stabilizer member comprising a tooth adjacent to one of said edges of each one of said pairs of edges and a recess adjacent to the other one of said edges of each of one of said pairs of edges, each of said sidewall members having either a said tooth or a said recess and each edge of said bottom member having a complementary said recess or said tooth, said tooth and said recess each having a restraint face which, when engaged by the other restrains the bottom member and respective sidewall member from lateral translational separation normal to said fold axis along the plane of one of said member, said tooth and recess being so disposed and arranged as to be interengaged with one another when the blank is folded with the plane of the sidewall member substantially normal to the plane of the bottom member.

2. A box blank according to claim 1 in which each of said members has an abutment surface at each of said pairs of edges, said abutment surfaces being substantially normal to one another when the nominal planes of the members are disposed parallel to one another, and in abutment with one another when the members are normal to one another.

3. A box blank according to claim 2 in which there are two sets of said abutment surfaces at each pair of edges, the two abutment surfaces on one of said members forming a recessed step, and the two abutment surfaces on the other of said members forming a dihedral angle which fits into said step when the nominal planes of the members are normal to one another.

4. A box blank according to claim 1 in which the recess and the tooth are both partially bounded by a respective pair of axially spaced apart end walls, which end walls abut one another in pairs when the nominal planes of the members are normal to one another, whereby to resist shear-wise movement of the members relative to one another along said fold axis.

5. A box blank according to claim 1 in which a spline is formed on one of said members and a complementary groove is formed in the other side of said members to interengage when the nominal planes of the members are normal to one another, said spline and groove being oriented normally to said fold axis, whereby to resist shearwise movement of the members relative to one another along said fold axis.

6. A box blank according to claim 1 in which the strap hinge is made of the same material as the members and is continuous and integral with said members, said strap hinge being thinner than said members, whereby to be flexible.

7. A box blank according to claim 6 in which the box blank is a one-piece molded body.

8. A box blank according to claim 7 in which the body is made of organic plastic material.

9. A box blank according to claim 1 in which complementary key means is provided at edges of the sidewall members where they abut when the blank is set up, whereby to interengage said sidewall members.

10. A box blank according to claim 1 in which a side of at least one of the sidewall members includes a retainer which can be engaged by a lid applied over the box when the sidewalls are raised above the bottom member.

11. A box blank according to claim 1 further including a lid having a top and a skirt.

12. A box blank according to claim 1 in which the bottom member has one of said teeth on one of its edges and one of said recesses in another of its edges.

13. A box blank according to claim 1 in which the bottom member has one of said teeth on alternating ones of its edges, and one of said recesses in the others of its edges.

14. A box blank according to claim 4 in which the bottom member has one of said teeth on one of its edges and one of said recesses in another of its edges.

15. A box blank according to claim 4 in which the bottom member has one of said teeth on alternating ones of its edges, and one of said recesses in the others of its edges.

* * * * *